US005441471A

United States Patent [19]

Passer

[11] Patent Number: 5,441,471

[45] Date of Patent: Aug. 15, 1995

[54] UNIVERSAL SPORT HANDLE

[76] Inventor: Bernard J. Passer, 1420 W. 240th St., Harbor City, Calif. 90710

[21] Appl. No.: 334,764

[22] Filed: Nov. 4, 1994

[51] Int. Cl.[6] ..... A63B 11/00; A63B 21/02

[52] U.S. Cl. ..... 482/106; 482/126; 482/109

[58] Field of Search ..... 482/106, 108, 93, 82, 482/109, 121–126; 273/26 B, 60 R

[56] References Cited

U.S. PATENT DOCUMENTS 4,722,523 2/1988 Yang ..... 482/106
5,037,087 8/1991 Roth ..... 482/108
5,379,909 1/1995 Roark ..... 482/108
5,393,284 2/1995 Wesley ..... 482/106

*Primary Examiner*—Stephen R. Crow
*Attorney, Agent, or Firm*—Monty Koslover Assoc.

[57] ABSTRACT

A sport exercise handle device is disclosed which adapts to commonly available components such as large soft-drink bottles to form a dumbbell, and a hand weight. Attachments to the handle produce a hand-rod holder for a bar-bell, a jump-rope using cord, an arm-expander exerciser using bungee-cords and even a jai-alai type ball catcher. These are some of the many hand sport equipments for which the universal handle may be used. The sport handle itself is inexpensive as are all attachments and components, producing inexpensive and easily assembled sports equipment.

4 Claims, 2 Drawing Sheets

Fig. 1.
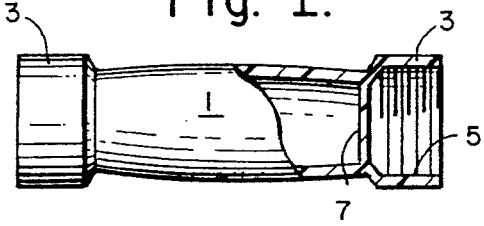
Fig. 2.
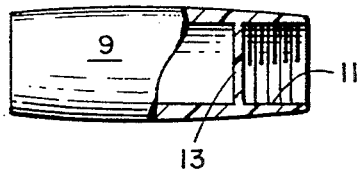
Fig. 3.
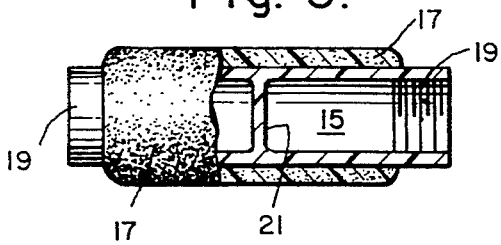
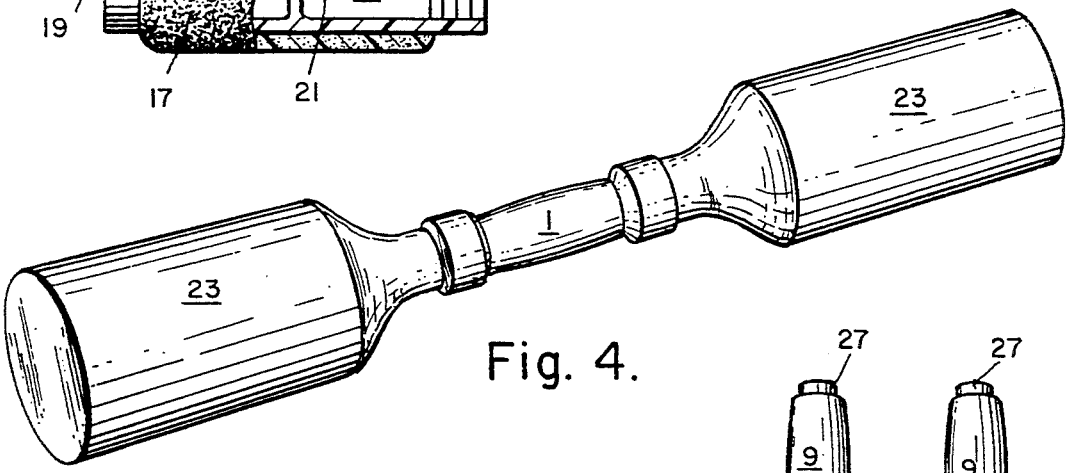
Fig. 4.
Fig. 5.
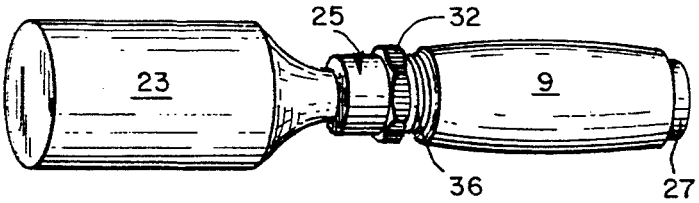
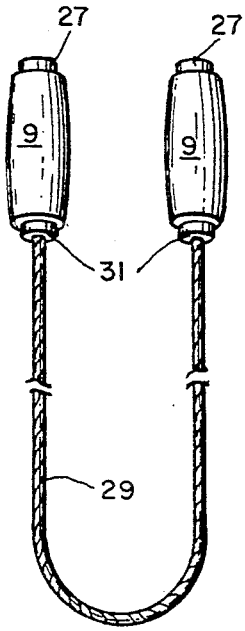
Fig. 8.
Fig. 6.
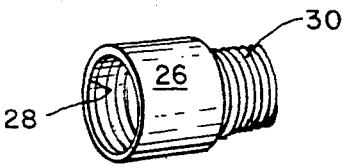
Fig. 7.
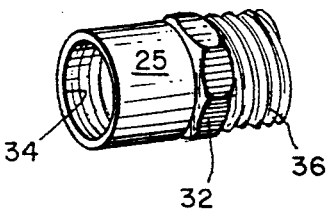
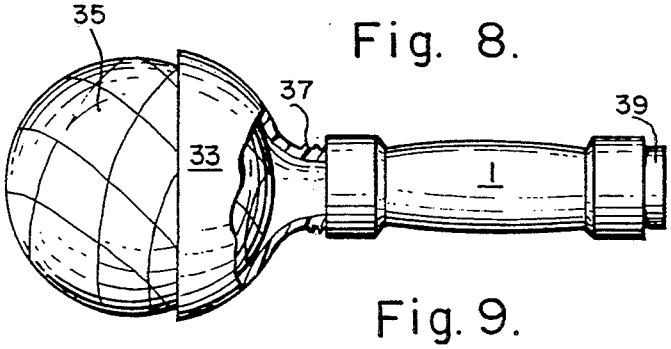
Fig. 9.

UNIVERSAL SPORT HANDLE

BACKGROUND AND SUMMARY OF THE INVENTION

This invention relates to sports exercise equipment and more particularly to a handle which may be used to assemble many different types of sports equipment inexpensively.

Sports exercise equipment of all types is expensive, as a glance at any of the current sports equipment store advertisements will affirm. For the average young man or woman who want to exercise daily, the cost of obtaining a set of equipment including weighted dumbbells, bar-bells, jump ropes, etc., is close to being prohibitive. Therefore, it is usually necessary to settle by joining a local health club if possible, and using their in-house equipment. In Southern California health clubs are readily available, but not generally so in every part of the country. Furthermore, club membership is not inexpensive, and this deters many from joining them. As a result, there is a widespread need for a cheap way of obtaining sports equipment for individual exercise.

The present invention is a handle which adapts to commonly available components such as soft-drink bottles to form a dumbbell, a bar-bell, and a hand weight. Attachments to the handle make it adaptable to a jump-rope, an arm-expander exerciser using bungee-cords and even a jai-alai type ball catcher. There are also no doubt other hand sport equipments for which the universal handle may be easily used. The sports handle itself is inexpensive as are all attachments and components, producing inexpensive and easily assembled sports equipment.

It is therefore a prime object of this invention to provide a handle which may be used by anyone to assemble a multitude of different inexpensive sports equipments for individual exercise.

BRIEF DESCRIPTION OF THE DRAWINGS

FIG. 1 is a partially cutaway front view of a sports handle in accordance with the present invention, particularly having internally threaded portions at each end of the handle;

FIG. 2 is an alternate configuration sports handle in accordance with the present invention, showing a partially cutaway front view and having internally threaded portions at each end of the handle;

FIG. 3 is another alternate configuration sports handle in accordance with the present invention, showing a partially cutaway front view and having internally threaded portions at each end of the handle;

FIG. 4 is a perspective view of a handle of the present invention attached to two weighted soft drink bottles, forming a dumbbell;

FIG. 5 is a side view of a handle of the present invention attached by a screw thread adaptor to a weighted bottle and forming a single hand weight;

FIGS. 6 and 7 are perspective views of two screw thread size adaptors intended for adapting an invention handle to added equipment components;

FIG. 8 is a front view of two handles of the present invention attached to a rope having threaded ends, forming a jump rope;

FIG. 9 is a side view of a handle and adaptor cup of the present invention being used to hold a ball;

DESCRIPTION OF THE PREFERRED AND ALTERNATE EMBODIMENTS

Figure 10:
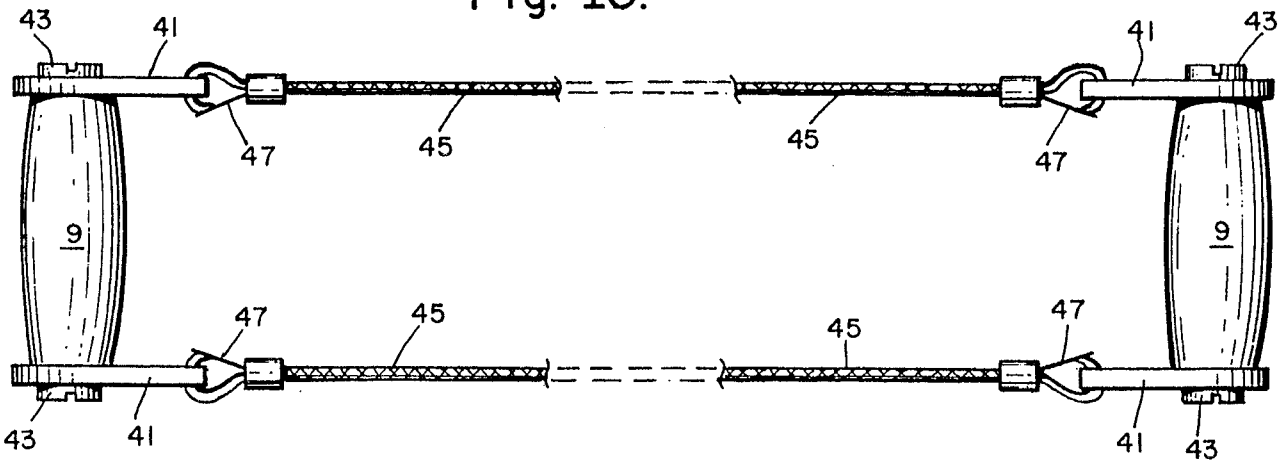
FIG. 10 is a plan view of an arm expander equipment made from two handles and end plates according to the present invention and multiple bungee cords.

FIG. 1 shows a partially cutaway view of a preferred embodiment universal sport handle 1. Alternate embodiment universal sport handles 9 and 15 are shown in partially cutaway views in FIGS. 2 and 3. The descriptive term "universal" is used because all of the above embodiments are designed for use in making a number of sport exercise equipments. Some of these sport exercise equipments are illustrated in FIGS. 4, 5, 8, 9, 10 and 12.

Referring to FIG. 1, it is seen that the preferred embodiment handle 1 is a hollow, tubular shaped member having a convex shaped outer surface and having stepped end portions 3 and screw threads 5 inside each stepped end portion 3. At least one blocking wall 7 is located across the inside of the hollow tube portion serving to support the tube walls and to prevent any fluids from passing from one end of the handle 1 to the other. The handle 1 is made from a molded rigid plastic material and sized to comfortably fit the grip of an adult hand. Handles for male adults will generally be larger than handles made for female adults to suit the hand size differential.

The threaded end portions 5 are sized to fit the screw tops of large soft drink bottles since attachment to such bottles is expected to be a major use of the handle. Screw thread adaptors illustrated in FIGS. 6 and 7 are provided for applications where attached components have other size screw ends.

An alternate embodiment handle 9 configuration is shown in FIG. 2. Like the preferred embodiment handle 1, this handle 9 is a hollow, tubular member having a convex shaped outer surface. However, it does not have a stepped end portion at each end, and thus is somewhat shorter than the preferred embodiment handle 1. A threaded portion 11 is contained inside each end of the handle 9 and at least one blocking wall 13 is located across the inside of the tube. The handle 9 is made from molded rigid plastic and is sized generally for an adult hand, although juvenile sized handles may be made.

FIG. 3 illustrates yet another alternate embodiment configuration handle 15. In this embodiment, the handle 15 comprises a plastic tubular member and a grip pad 17 which covers most of the tubular member. A threaded portion 19 is located inside each end of the handle 15 and at least one blocking wall 21 is located across the inside of the tubular member.

FIGS. 4 and 5 illustrate two of the possible applications for the sports handle. In FIG. 4, two large soft drink bottles 23 are shown screwed into the ends of a handle 1. The bottles 23 would be filled fully or partially with sand or water before attaching the handle 1. This makes an inexpensive weighted dumbbell. Of course the weights are variable, depending on the amount and type of filler put in the bottles 23. In FIG.

6 only one soft drink bottle 23 is used for a single weight. In this application, a thread adaptor 25 is shown being used to attach the bottle 23 to a handle 9, assuming a difference in bottle and handle thread sizes. A threaded cap 27 protects the open end of the handle 9 from grit. As for the dumbbell, the bottle 23 would be filled with desired weight material such as sand or water prior to attaching to the handle.

FIGS. 6 and 7 illustrate two different thread adaptors 25, 26. In FIG. 6, the thread adaptor 26 is used to step up the thread size of the handles to a larger thread size. The adaptor 26 is a plastic or metal tubular member having an internally threaded portion 28 and an externally threaded portion 30; the externally threaded portion being the same size as the handles 1, 9, 15 threaded portions.

FIG. 7 shows a thread adaptor 25 which is used to attach a handle to a component having a smaller thread size, such as illustrated in the FIG. 5 application. The adaptor 25 is a plastic or metal tubular member having an internally threaded portion 34 and an externally threaded portion 36, the externally threaded portion 36 being the same size as the handles 1, 9, 15 threaded portions. The adaptor 25 includes a hex-edged portion 32 around its diameter to assist in tightening the adaptor in place.

Refer now to FIGS. 8 and 9 which show two more applications of the sports handle of the present invention. In FIG. 8, a jump rope is assembled by attaching the threaded ends 31 of a rope 29 to two sport handles 9. Threaded dust caps 27 are attached to the open ends of the handles 27 to protect against grit entry. Where ropes with threaded ends are not available, threaded screws with clamps for the rope can be found in most hardware stores, and will serve well to fasten the rope to the handles, making an inexpensive jump rope.

In FIG. 9, a cup member 33 is attached by external threads 37 to one end of a sports handle 1. The cup shaped member attachment to a handle forms an equipment suitable for catching or throwing a ball 35. The cup member 33 also could support any component having a semi-spherical shaped portion which is permanently attached by glue or other adhesive to the cup member 33. A dust cap 39 is attached by screw threads to the open end of the handle 1.

Figure 11:
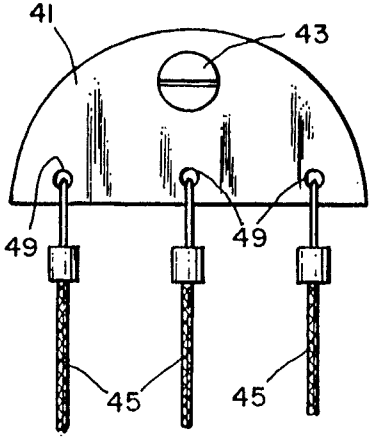
FIG. 11 is an end view of one end of an arm expander equipment, particularly showing detail of an end plate which is attached to one of the handles.

Referring now to FIGS. 10 and 11, there is shown in FIG. 10 a plan view of an arm-expander exerciser assembled from two sport handles and attachments. FIG. 11 is a side elevation view of one end of the exerciser equipment. In this application the exerciser is made from two sport handles 9 with attachments and six bungee cords 45. Each sport handle plus attachments comprises a handle 9, two end plates 41 and two fastening screws 43. The fastening screws 43 have a male thread size matching the size of the threads 11 in each end of a handle 9. Means for supporting the bungee cords 45 is provided by two end plates 41, which are fastened one to each end of a handle 9 by a screw 43.

The end plates 41 are preferably made of rigid aluminum sheet and are shaped to form a half circle. A large hole is provided near the center of each plate 41 to accommodate the fastening screw 43. At least three small holes 49 are drilled in the plate located along a line parallel and near to the bottom straight edge of the plate 41. These small holes 49 are for the purpose of attaching the ends 47 of the bungee cords 45. Care is taken to locate and space the holes 49 such that the attached bungee cords will be balanced and not pull off center.

Figure 12:
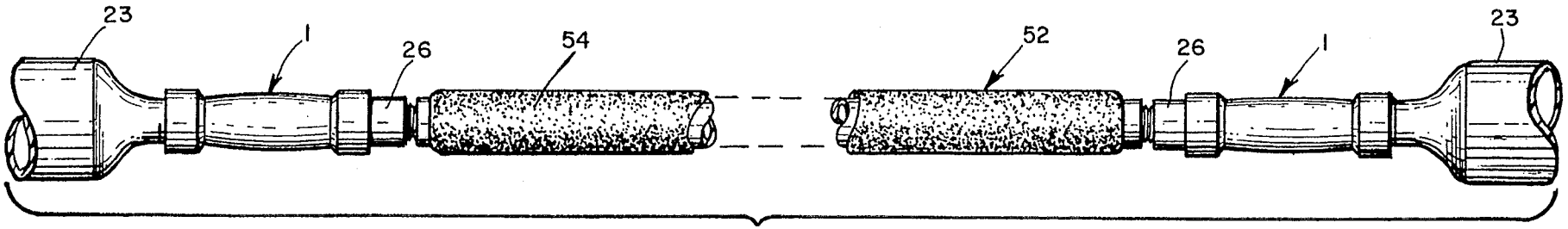
FIG. 12 is a partial front view of a bar-bell made from two handles, a center bar and two thread adaptors according to the present invention, and two soft drink, weighted bottles.

Another equipment application for the sport handles is illustrated in FIG. 12. In this application, an extended length rod 52 is used together with two thread adaptors 26 and two handles 1 to form a long hand-bar to which can be attached two weighted bottles 23 or other weights, forming a bar-bell. The extended length rod 52 comprises a long aluminum tubular member and a grip pad 54 which covers most of the outside of the tubular member. For this rod 52 which will carry a considerable stress load, a strong material construction such as thick aluminum tubing is required.

Extending from each end of the rod 52 is a male threaded portion, which because of stress considerations, will have a larger size diameter than the handle 1 threaded portions. Therefore, a thread adaptor 26 is required at each end of the rod 52 to fasten the rod to each handle 1.

The extended length rod 52 is in several lengths and sizes, permitting different weights up to a set limit of over 100 pounds to be attached to the ends of an assembled long hand-bar. This hand-bar of the present invention can be thus used to produce a bar-bell adequate for exercise purposes at a cost far below commercially available bar-bells. It should be noted that a bar-bell made with the foregoing construction is limited in the maximum weight it can carry. However, for beginning exercisers this limit should suffice.

In the foregoing discussion several configuration sport handles have been described and several applications for the handles plus special attachments have been illustrated. In all the illustrated applications, a useful sports exercise equipment is easily and inexpensively assembled. In fact, much of the added components such as the soft-drink bottles can be recycled in this manner. This is an added advantage to this invention. It is expected that imaginative users can come up with many more useful applications for the sport handle disclosed herein.

While the present invention has been described herein by the embodiments and their applications, it will be understood by those skilled in the art that various changes may be made. These changes and alternatives are considered to be within the spirit and scope of the present invention.

Having described the invention, what is claimed is:

1. A handle-support assembly comprising a sport exercise handle and first means for securing a multiplicity of bungee cords to the end of said handle; said handle comprising a molded plastic tubular member having a convex shaped outer surface, said outer surface being sized to fit the grasp of a hand, said tubular member including a female screw threaded portion inside each end;

said first means including two metal plate members and two screws, each said metal plate member being half-moon shaped and having a first hole cut in its center, said first hole being sized to accommodate one of said screws, said metal plate member also including at least three second holes, said second holes being located near the straight edge of said plate member and sized to accommodate the hooked end of a bungee cord, said second holes being separated and arranged in a manner to balance the pull of attached bungee cords; each said screw having a male threaded portion sized to couple with said female threaded portions in the ends of said tubular member; said plate members being attached by said screws, one to each end of said handle so that the plane of each said plate is at 90 degrees to the longitudinal axis of said handle, and the straight edge of each plate is in the same direction; two said handle-support assemblies able to be connected with at least six bungee cords to form an arm-exerciser equipment.

2. The handle-support assembly according to claim 1, wherein said handle tubular member is hollow and incorporates at least one barrier defining separate internal chambers, said barrier acting to seal one chamber from the others.

3. A bar-bell hand-bar device comprising:

(a) a first sport handle;

(b) a first thread adaptor means coupled to an end of said first sport handle;

(c) an elongated metal tubular member, said elongated metal tubular member including a male screw threaded portion at each end and having a grip pad surrounding the outside surface of said metal tubular member, said metal tubular member being coupled at one end to the free end of said first thread adaptor means;

(d) a second thread adaptor means coupled to the distal end of said elongated metal tubular member; and (e) a second sport handle coupled to the free end of said second thread adaptor means;

each said sport handle comprising a molded rigid plastic tubular member having a convex shaped outer surface and a stepped portion at each end of said tubular member, said outer surface being shaped and sized to fit the grasp of a hand, each said stepped portion including a female screw threaded portion inside each end, said plastic tubular member being hollow and incorporating at least one barrier defining separate internal chambers, said barrier acting to seal one chamber from the others;

said bar-bell hand-bar device having weighted bottles or other weighted components coupled and attached to each end of said hand-bar device forming a bar-bell useful for performing weight lifting exercises.

4. The device according to claim 3 wherein said first and second thread adaptor means includes a metal tubular member having a female screw threaded portion in one half and a male screw threaded portion in line in the other half, said male screw threaded portion being sized to couple with the threaded portion at the ends of said sport handle, said female screw threaded portion being sized for a larger diameter coupling, adapting to a larger threaded coupling than that in said sport handle.

* * * * *